United States Patent [19]

Renzo

[11] Patent Number: 4,930,672

[45] Date of Patent: Jun. 5, 1990

[54] STORING TRANSFER APPARATUS TO INTERCONNECT DEVELOPING AND PRINTING MACHINES FOR CONTINUOUS STRIP PHOTOGRAPHIC MATERIAL

[75] Inventor: Panontin Renzo, Fiume Veneto, Italy

[73] Assignee: Gregoris Photo Equipment S.p.A., Azzano Decimo, Italy

[21] Appl. No.: 264,063

[22] Filed: Oct. 28, 1988

[51] Int. Cl.[5] ..... B65H 20/24

[52] U.S. Cl. ..... 226/119; 226/118

[58] Field of Search ..... 226/118, 119, 189; 242/47.5, 55.1

[56] References Cited

U.S. PATENT DOCUMENTS

| | | | |
|---|---|---|---|
| 3,385,489 | 5/1968 | Schreck, Jr. et al. | 226/42 X |
| 3,501,076 | 3/1970 | Stuart et al. | 226/118 X |
| 3,682,363 | 8/1972 | Hull | 226/118 |
| 4,009,814 | 3/1977 | Singh | 226/119 X |
| 4,360,137 | 11/1982 | Noe et al. | 226/119 X |
| 4,771,621 | 9/1988 | Sato | 226/119 X |
| 4,782,354 | 11/1988 | Gregoris | 226/118 X |

FOREIGN PATENT DOCUMENTS

| | | | |
|---|---|---|---|
| 2029638 | 3/1983 | Fed. Rep. of Germany | 226/119 |

*Primary Examiner*—Stuart S. Levy
*Assistant Examiner*—E. Dunlap
*Attorney, Agent, or Firm*—Leonard Bloom

[57] ABSTRACT

Storing transfer lung to interconnect developing and printing machines for continuous strip photographic material, comprising:

a means in a fixed position having upper transmission rollers on a horizontal axis (4-10-, 3, 12-18, 11, 20-26, 28-34, 27, 36), cooperating with a lower means on a vertically mobile frame (36,37) with lower transmission rollers on a horizontal axis (4'-10', 11'-17', 3', 20'-26', 27'-33'), below the first ones, in which said storing lung consists of:

at least one set of transmission rollers arranged in longitudinal rows parallel to each other, the heads being close to each other, with the rotary axis slanted on the horizontal axis in respect to the lining-up of the respective row (4-10, 12-18, 20-26, 28-34) included in said fixed position means, having upper transmission rollers on a horizontal axis (4-10, 3, 12-18, 11, 20-26, 28-34, 27, 36)

at least one set of transmission rollers arranged in longitudinal rows parallel to each other, the heads being close to each other, with the rotary axis slanted on the horizontal surface in respect to the lining-up of the respective row, but in the opposite direction to the orientation of the upper row of rollers (4'-10', 11'-17', 20'-26', 27'-33') (FIG. 1); the aforesaid set of rollers being included below the first ones in said vertically mobile means with lower transmission rollers on a horizontal axis (4'-10', 11'-17', 3', 20'-26', 27'-33').

3 Claims, 4 Drawing Sheets

STORING TRANSFER APPARATUS TO INTERCONNECT DEVELOPING AND PRINTING MACHINES FOR CONTINUOUS STRIP PHOTOGRAPHIC MATERIAL

FIELD OF THE INVENTION

The subject of the present invention is a Storing Transfer Lung to Interconnect Developing and Printing Machines for Continuous Strip Photographic Material.

The innovation has a particular and convenient, although not exclusive, application for use in developing both negatives and also positives or printed material.

BACKGROUND OF THE INVENTION

The necessity of using such storing lungs between the continuous processing machines for developing and printing, cutting and eventual preparation and packing of photographic material is known in the present state of art. To this end, see the characteristics of the developing and printing system for photographic material (both film and paper) of the type described in Italian application No. 83382A/85 of 12-7-85 in the same applicant's name (corresponding to U.S. Pat. No. 3623084.7), in which the respective storing lungs foresee a snake-like stretching of the strip of photographic material or support of said at both ends, by means of a frame on a fixed plane with upper transmission rollers which cooperates with the vertically mobile frame of lower transmission rollers below the first one.

According to the characteristics of the above-mentioned system, the respective storing lungs foresee that the corresponding transmission rollers of the strip of photographic material to be treated, alternatively the strips in continuation of non-photographic material as supports for the beginning and end, are of the self-rotating type.

However, even if this concept of self-rotation has its advantages, it also presents disadvantages deriving above all from the fact that undesired rotations of the corresponding support rollers may occur, thus causing danger of impediments and entanglements.

Furthermore, as the actual storing lungs have to accumulate a large quantity of material, they must necessarily be of big dimensions and are therefore bulky or, alternatively, the quantity of stored material is limited, with consequent restrictions on the possibility of automatization and being to optimize the operativity of the various machines which are connected to the maximum limit.

The scope of the present invention is to realize a storage lung which is able to eliminate the above-mentioned inconveniences.

SUMMARY OF THE INVENTION

The present innovation, as per the characteristics given in the attached claims, solves the problem by using a storing lung comprising a means in a fixed position having upper transmission rollers on a horizontal axis which cooperates with a vertically mobile means with lower transmission rollers on a horizontal axis, below the first ones, in which said storing lung comprises:

at least one set of transmission rollers arranged in longitudinal rows parallel to each other, the heads being close to each other, and with the rotation axis slanted on the horizontal plane in respect to the lining-up of the respective row is included in said fixed position means having upper transmission rollers on a horizontal axis;

at least one set of transmission rollers arranged in longitudinal rows parallel to each other, the heads being close to each other, with the rotary axis slanted on the horizontal surface in respect to the lining-up of the respective row but in the opposite direction in respect to the orientation of the upper row of rollers, included in said vertically mobile means with lower transmission rollers on a horizontal axis, below the first ones.

The advantages gained from this innovation consist essentially in the fact that the capacity for accumulation of waiting material having equal overall dimensions, increases 2.5 times in respect to the traditional system and the inoperative part of material used in the respective storing lung decreases by 60%.

Advantageously:

The respective slantings of the upper transmission rollers are equal to those of the lower transmission rollers. A better arrangement of the rollers and a more effective transmission deviation is obtained with this solution.

The rows of rollers are grouped in parallel pairs having opposed inclinations (herring-bone pattern). This solution makes a return run possible for each pair.

At least two pairs of rows (a total of four rows) are foreseen. This solution noticeably increases the storing capacity with equal overall dimensions.

At least one auxiliary traction roller is foreseen downstream of each upper row. This solution reduces the tension by 50% in respect to the solutions with single traction.

Upstream and downstream of the structure having rows of slanted transmission rollers, as per the above-mentioned characteristics, compensating devices are foreseen which comprise a set of fixed rollers on the upper row and a set on a vertically mobile frame of rollers in a lower row, these being positioned with the rotary axis orthogonal and horizontal to the respective row, and the rollers of the upper row being arranged in a staggered position in respect to those of the lower row.

The innovation is hereafter explained in more detail with the assistance of the drawings giving the preferential realization solutions, the execution details of which are not to be held as limiting but only as examples.

DESCRIPTION OF THE PREFERRED EMBODIMENTS

With reference to the above figures, it can be seen that the storing lung (transfer apparatus) comprises a central body which forms the real storing place (B)

with two lateral compensating wings (A), being respectively one for entry and one for exit (entry side and exit side).

The compensating wings comprise a set of rollers, respectively:

a fixed, upper, horizontal row (1), a lower, horizontal row (2) on a mobile stretching frame (2') vertically intercalated in respect to the position of the upper rollers, all of it lying on a vertical plane corresponding to the progress plane of the strip of material to be stored, arranged parallel to each other, horizontally and orthogonally to the vertical progress plane of the strip to be stored.

The central storing place includes:

a means in a fixed position having upper transmission rollers on a horizontal axis (4-10, 3, 12-18, 11, 20-26, 28-34, 27, 36), cooperating with a lower means on a vertically mobile frame (36, 37) with lower transmission rollers on a horizontal axis (4'-10', 11'-17', 3', 20'-26', 27'-33'), below the first ones, in which the said storing lung comprises:

at least one set of transmission rollers set having an entry end and an exit end arranged in longitudinal rows parallel to each other, the heads being close to each other, with the rotary axis slanted at an acute angle in a one direction on the horizontal axis in respect to the lining-up of the respective row (4-10, 12-18, 20-26, 28-34) included in said fixed position means, having upper transmission rollers on a horizontal axis (4-10, 3, 12-18, 11, 20-26, 27, 36); Auxiliary Traction rollers (3, 11, 27, 36) are included.

at least one set of transmission rollers arranged in longitudinal rows parallel to each other, the heads being close to each other, with the rotary axis slanted (at an acute angle) on the horizontal surface in respect to the lining-up of the respective row, but in the opposite direction to the orientation of the upper row of rollers (4'-10', 11'-17', 20'-26', 27'-33') the aforesaid set of rollers being included below the first ones (i.e. the upper set of rollers) in said vertically mobile means with lower transmission rollers on a horizontal axis (4'-10', 11'-17', 3', 20'-26', 27'-33').

Advantageously:

The respective slantings of the upper transmission rollers (4-10, 12-18, 20-26, 28-34) are equal to those of the lower transmission rollers (4'-10', 11'-17', 20'-26', 27'-33').

Figure 1:
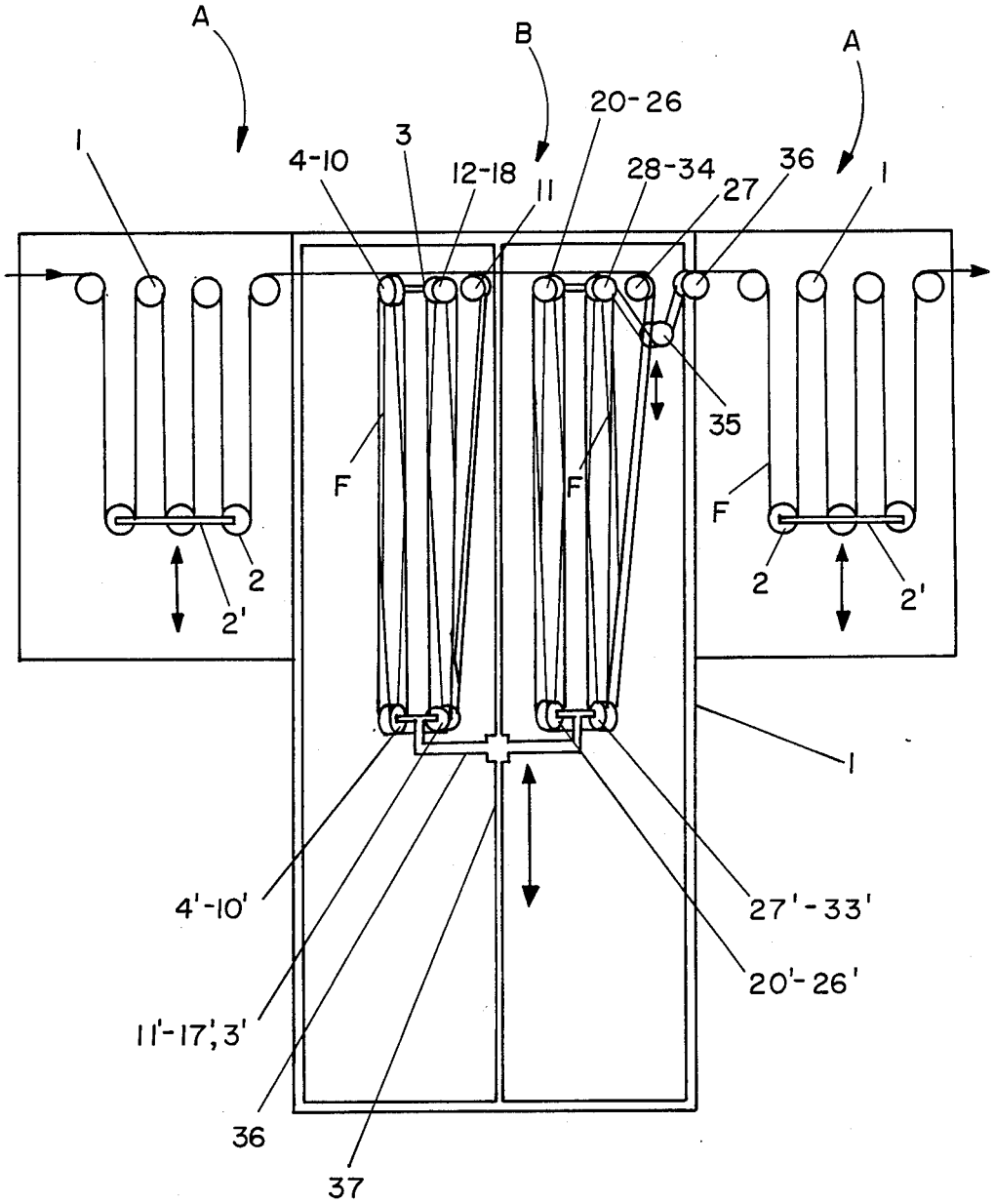
FIG. 1 gives a schematic view of the front elevation of the storing lung.
Figure 2:
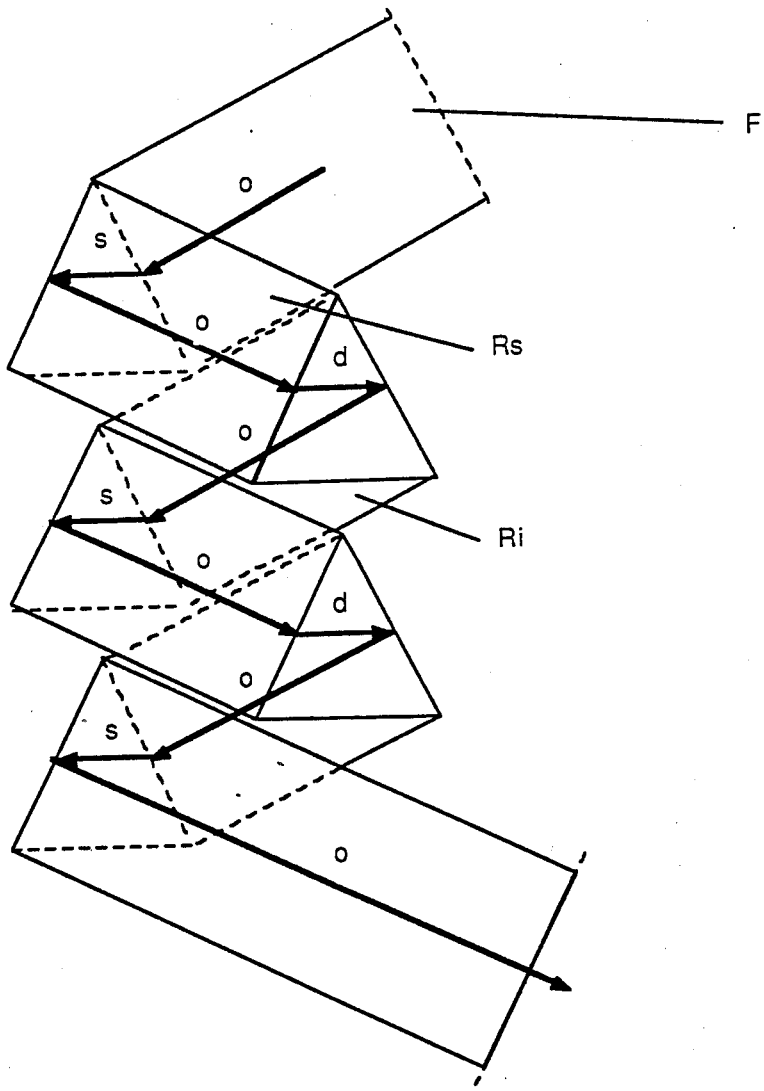
FIG. 2 gives a schematic view from above of the material progress system along a respective pair of rows, one being above and one below.
Figure 3:
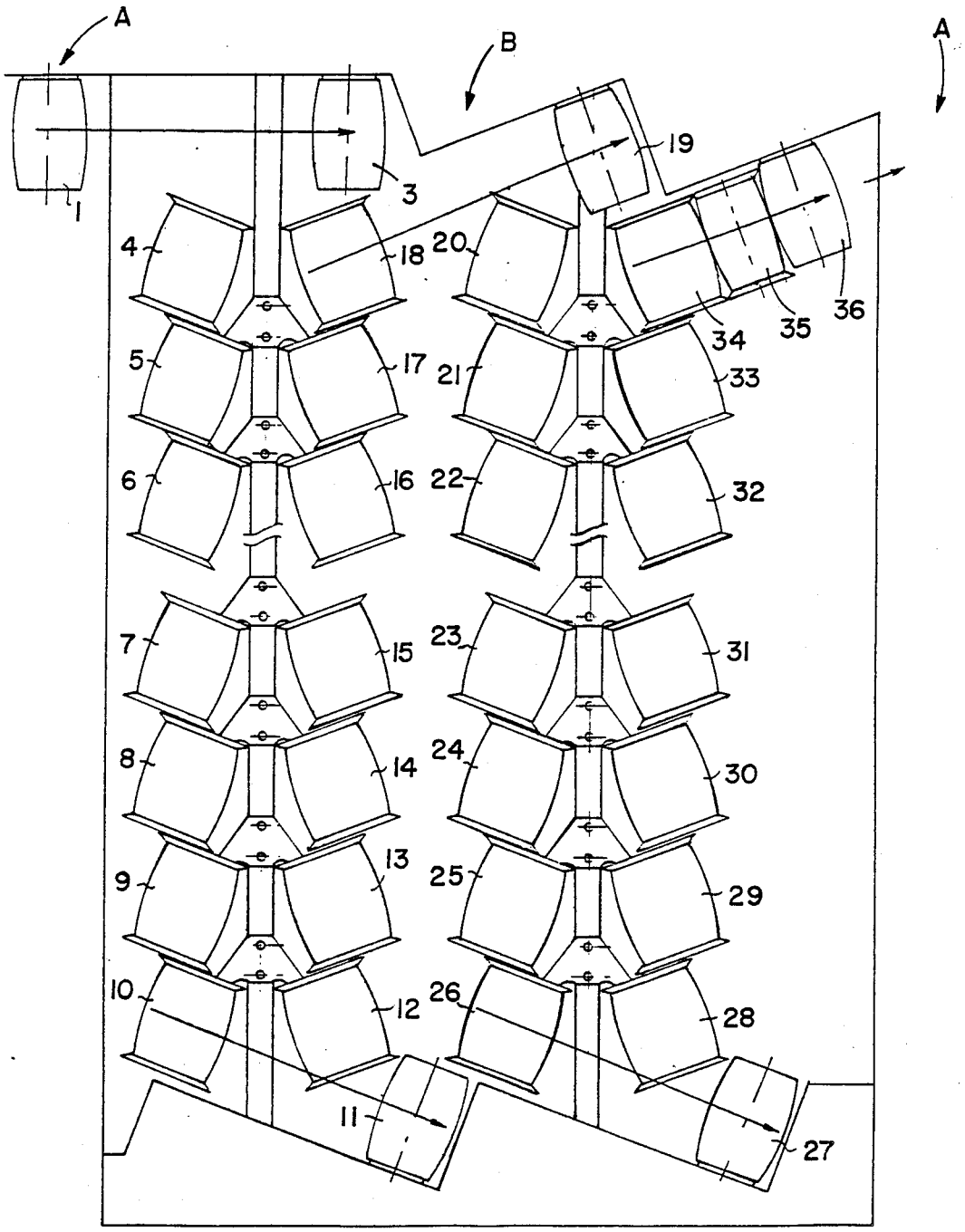
FIG. 3 gives a view from above of the upper fixed frame of deviation rollers slanting away from the central body.
Figure 4:
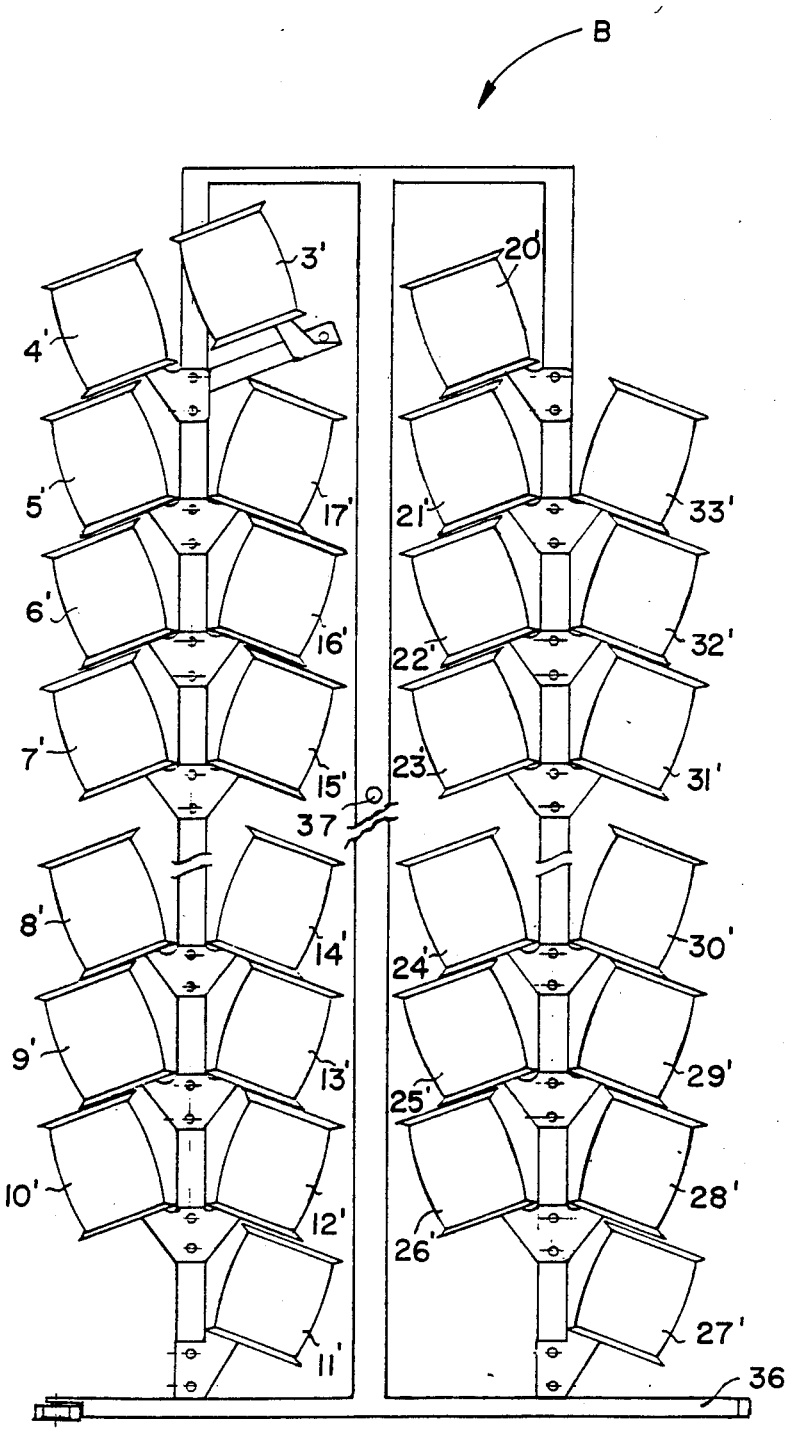
FIG. 4 gives a view from above of the lower mobile frame of deviation rollers slanting away from the central body.

The rows of rollers are grouped in parallel pairs having opposed inclinations, herring-bone pattern (4-10/4'-10', 12-18/11'-17' and/or 20-26/20'-26', 28-34/27'-33'), as it is foreseen that the strip of material to be stored is spiroidally and helicoidally wound according to the return run of the rows, that is to say, a horizontal forwards and backwards movement for each pair of rows. Thus, as shown in FIG. 3, the herringbone pattern in the upper level diverges from the entry side of the central body and, as shown in FIG. 4, the herringbone pattern in the lower level converges from the entry side of the central body.

At least two pairs of rows are foreseen (4-10/4'-10', 12-18/11'-17' and 20-26/20'-26', 28-34/27'-33').

At least one auxiliary traction roller (11, 19, 27, 35/36) is foreseen downstream of each upper row (4-10, 12-18, 20-26, 28-34) to act as normalizing means for the tension of the stored strip, being of the motorized type with a pair of compensating traction rollers.

upstream and downstream of the structure having rows of slanted transmission rollers, as per the above-mentioned characteristics, the said compensating devices (A) are foreseen which comprise a set of fixed rollers on the upper row (1) and a set on a vertically mobile frame (2') of rollers on the lower row (2), these being positioned with the rotary axis orthogonal and horizontal to the respective row, and the rollers of the upper row being arranged in a staggered position in respect to those of the lower row, all of it realizing an essentially "T"-shaped arrangement, with the run plan also being essentially "T"-shaped, having entry at one side and exit at the other, and where the stem of the "T" presents at least one forward and backward run.

A traction roller (3) is advantageously foreseen between the compensating entry device (A) and above and at the head of the central storing place (B), and is associated with a transmission roller on the lower mobile frame (3') which conducts the strip to be stored to the first roller (4') of the first row (4'-10') of the lower mobile frame (36), from which it reascends in a twisting fashion to be sent on to the first (entry) roller (4) of the first row (4-10) of the upper fixed frame, to then redescend in a twisting fashion to be sent once again upwards from the second roller (5') of the first lower row (4'-10') on to the second upper roller (5), and so on until it reaches the last (exit) upper roller (10) of the first row from where it is sent by the auxiliary, tension normalizing, traction roller (11) to the first lower roller (11') of the second row (11'-17'), and from there onto the first roller (12) of the second upper row (12-18), and so on until it completes the run of the second row, the last roller (18) of which is deviated by the supplementary, tension normalizing, traction roller (19) to continue forward in a similar manner on the third row (20'-20-21'-21 . . . 26), at the end of which it is sent by a respective, supplementary, tension normalizing, traction roller (27) to return along the fourth row according to the run (27'-28, 28'-29 . . . 34), from where it is conveyed to the exit compensator (B) by a respective stretching roller (35), as the run of the stored strip on each row alternates between the upper rollers (Rs=4-10, 12-18, 20-26, 28-34) and the lower ones (Ri=4'-10', 11'-17', 20'-26', 27'-33'), the run consisting of:

horizontal deviation (o),
twisting ascent (s),
horizontal deviation (o),
twisting descent (d),
horizontal deviation (o),
twisting ascent (s);
. . .

and so on, where each deviation (s,d) corresponds substantially to the following formula:

(inclination of upper roller Rs+inclination of lower roller Ri/2.

What is claimed is:

1. Storing transfer apparatus to interconnect developing and printing machines for continuous strip photographic material, comprising a central unit having a plurality of rollers arranged respectively on an upper, fixed level and on a lower, mobile level to stretch and tauten a strip of material to be stored alternatively from an upper roller to a lower roller, from the lower roller to the upper roller and sequentially in this alternating manner comprising a means in a fixed position having upper transmission rollers on an upper horizontal axis, cooperating with a lower means on a vertically mobile frame with lower transmission rollers on a lower horizontal axis, below the upper rollers, in which the storing apparatus comprises: at least one upper set of transmission rollers arranged in longitudinal rows parallel to each other, each roller having a head and a rotary axis, the heads being close to each other, with the rotary axis of each roller aligned in one longitudinal row slanted in a one direction from the upper horizontal axis, wherein each set of rollers has an entry end and an exit end and an auxiliary traction roller is disposed at the entry end and the exit end of each upper roller; at least one lower set of transmission rollers arranged in longitudinal rows parallel to each other, each lower roller having a head and a rotary axis, the heads being close to each other, with the rotary axis of each lower roller aligned in one longitudinal row slanted from the lower horizontal axis, in an opposite direction to the one direction of a corresponding upper row of rollers, the lower set of rollers being included in said vertically mobile frame below the upper set of rollers; wherein the rows of rollers in each set are grouped in parallel pairs having a first row and a second row with opposed slantings forming a herringbone pattern, such that the strip of material to be stored is spiroidally and helicoidally wound according to return runs of the rows, passing sequentially in a first direction from upper roller to lower along the first row and returning in the opposite direction along the second row.

2. A storing transfer apparatus to interconnect developing and printing machines for continuous strip photographic material comprising:

a central body having an entry side and an exit side, a compensatory device on the entry side and a compensatory device on the exit side;

each compensatory device having a fixed upper row of rollers on a horizontal axis and a lower horizontal row of rollers on a parallel horizontal axis; the lower row of rollers being movable in a vertical plane with respect to the horizontal axis such that the strip of photographic material may be conducted through the rollers;

the entry side of the central body having a traction roller disposed therein to conduct the photographic strip material from the entry compensatory device into the central body;

the central body further having a plurality of transmission rollers arranged respectively on an upper fixed level and on a cooperating lower mobile level to stretch and tighten the strip of material;

the transmission rollers in the upper level being disposed along a horizontal axis in a first row and a parallel second row, each transmission roller having a rotary axis, the rotary axis of each transmission roller in the first row being slanted at an acute angle from the horizontal axis such that each roller has a rotary axis parallel to the rotary axis of each other roller in the first row; the rotary axis of each transmission roller in the second row being slanted at an equal and opposite acute angle from the horizontal axis such that each roller has a rotary axis parallel to the rotary axis of each other roller in the second row, such that the rollers in the first row and the rollers in the second row are arranged in a herringbone pattern diverging from the entry side of the central body having a one direction;

the transmission rollers in the lower level being disposed along a parallel horizontal axis arranged in a herringbone pattern converging from the entry side of the central body and having an opposite direction from the one direction of the herringbone pattern of the rollers in the upper level;

whereby when the strip of photographic material is conducted through the control unit, the material alternately moves from the transmission roller on the upper level to the corresponding transmission roller on the lower level, to the next adjacent transmission roller on the upper level and sequentially therethrough from the first row to the second row, the strip of photographic material being stored spiroidally and wound helicoidally; and the exit side of the central body having a traction roller disposed therein to conduct the photographic strip material from the central unit into the exit compensatory device.

3. The storing transfer apparatus of claim 2, wherein four rows of transmission rollers are disposed in the upper level and four rows of transmission rollers are disposed on the lower level such that two parallel herringbone patterns having a first direction are formed in the upper level and two parallel herringbone patterns having a second and opposite direction are formed in the lower level.

* * * * *

UNITED STATES PATENT AND TRADEMARK OFFICE

CERTIFICATE OF CORRECTION

PATENT NO. : 4,930,672

DATED : June 5, 1990

INVENTOR(S) : RENZO

It is certified that error appears in the above-identified patent and that said Letters Patent is hereby corrected as shown below:

On the title page, item [75]:

Change inventor's name from "Panontin Renzo"

to -- Renzo Panontin --.

Signed and Sealed this

Twenty-third Day of July, 1991

*Attest:*

*Attesting Officer*

HARRY F. MANBECK, JR.

*Commissioner of Patents and Trademarks*